US011702786B2

(12) United States Patent
Roetker

(10) Patent No.: US 11,702,786 B2
(45) Date of Patent: Jul. 18, 2023

(54) WASHER APPLIANCE ARTICLE MOVEMENT MECHANISM

(71) Applicant: Haier US Appliance Solutions, Inc., Wilmington, DE (US)

(72) Inventor: John Joseph Roetker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 21 days.

(21) Appl. No.: 17/197,201

(22) Filed: Mar. 10, 2021

(65) Prior Publication Data

US 2022/0290352 A1 Sep. 15, 2022

(51) Int. Cl.
*D06F 37/12* (2006.01)
*D06F 37/40* (2006.01)

(52) U.S. Cl.
CPC ..... *D06F 37/12* (2013.01); *D06F 37/40* (2013.01)

(58) Field of Classification Search
CPC ..... D06F 13/02; D06F 13/00; D06F 17/10; D06F 17/06; D06F 39/024; D06F 37/40; D06F 39/10; D06F 37/12
USPC ..... 68/134
See application file for complete search history.

(56) References Cited

U.S. PATENT DOCUMENTS 3,987,508 A * 10/1976 Platt ..... D06F 13/00 8/159
3,987,651 A 10/1976 Platt
3,987,652 A * 10/1976 Ruble ..... D06F 13/00 68/134
4,048,820 A * 9/1977 Pielemeier ..... D06F 13/00 366/277
4,391,107 A 7/1983 Gibson
5,557,952 A * 9/1996 Sundell ..... D06F 13/02 68/134
5,611,221 A * 3/1997 Tremel ..... D06F 17/08 68/133
D381,140 S * 7/1997 Pinkowski ..... D32/26
5,651,278 A * 7/1997 Pinkowski ..... D06F 13/02 68/133
5,689,847 A * 11/1997 Tremel ..... D06F 17/08 68/134
6,212,722 B1 * 4/2001 Pinkowski ..... D06F 17/06 8/158
6,497,121 B1 * 12/2002 Walsh ..... D06F 13/02 68/19.2
9,115,452 B2 8/2015 Carr
9,803,304 B2 10/2017 Calmeise
9,803,305 B2 10/2017 Holzen
10,787,761 B2 * 9/2020 Czarnecki ..... D06F 17/10
2004/0016267 A1 * 1/2004 Clark ..... D06F 13/02 68/133

(Continued)

*Primary Examiner* — David G Cormier
*Assistant Examiner* — Thomas Bucci
(74) *Attorney, Agent, or Firm* — Dority & Manning, P.A.

(57) ABSTRACT

A washing appliance having an article movement mechanism including an impeller and agitator post. An impeller is positioned in the wash drum and is rotational about a vertical axis and is configured for imparting motion to the articles during washing. An agitator post is positioned adjacent to the impeller and is also rotational about the vertical axis. The agitator post includes a plurality of vane sets spaced apart along the vertical axis with each vane set including at least one helical vane.

17 Claims, 7 Drawing Sheets

(56) References Cited

U.S. PATENT DOCUMENTS

| | | | | |
|---|---|---|---|---|
| 2005/0284191 | A1* | 12/2005 | Turner | D06F 37/12 68/12.02 |
| 2007/0062224 | A1* | 3/2007 | La Belle | D06F 13/02 68/3 R |
| 2021/0062382 | A1* | 3/2021 | Andrejczuk | D06F 17/10 |

* cited by examiner

WASHER APPLIANCE ARTICLE MOVEMENT MECHANISM

FIELD OF THE INVENTION

The subject matter of the present disclosure relates generally to a washer appliance having an improved article movement mechanism including an impeller and agitator post.

BACKGROUND OF THE INVENTION

Washing appliances (also referred to as "washing machines") typically include a drum or basket for receipt of articles to be washed. Top-load or vertical axis washing machines rotate the drum about the vertical axis at various points during the cleaning cycle. Various components provide for adding fluid into the drum and for imparting motion to the fluid and articles being washed in order to clean the articles.

Conventionally, the washing appliance may include a knob or other switch by which the user selects the level of fluid in the vertical axis washing machine based on e.g., the load size of articles being washed. The user visually determines the desired fluid level based on the anticipated load size. Many washing appliance users are also accustomed to seeing a conventional agitator extending up from the bottom of the wash basket for purposes of imparting motion to the fluid and articles during the cleaning cycles. Users may associate factors such as fluid level and movement of the agitator as directly related to the effective cleaning of the articles and may believe that increased fluids levels and agitator action are advantageous.

Improvements in technology and increasing water conservation requirements have resulted in washing appliances that use less water during the cleaning cycle. For example, as a matter of convenience and to reduce the use of an unnecessary level of fluid, the appliance may have features that automatically select fluid level based on load size detection. User reliance on such features can help circumvent unnecessary water consumption that occurs when users select higher fluid levels than needed. Additionally, higher fluid levels can also result in an undesirable lower of detergent concentration. The appliance may have features that improve the agitation of articles during the cleaning cycle. Such can also be useful in reducing water consumption if the improvements in agitation allow for using less water and while also maintaining higher detergent concentrations.

However, user perception of washing machine features that provide for the best cleaning experience may contradict the actual impact of such features. As previously mentioned, consumers familiar with a conventional agitator extending vertically from the bottom of the wash drum may be reluctant to purchase or use a vertical-axis washing appliance lacking such feature. Yet, depending on the particular design employed, an impeller located at the bottom of the wash drum may have more impact in creating the desired agitation and cleaning of articles than the conventional agitator—including under conditions of less water usage.

Accordingly, a vertical axis washing appliance that can provide improved cleaning would be beneficial. More particularly, a vertical axis washing machine that utilizes an impeller to impart the desired motion to articles being washed and that can clean effectively while consuming less water would be particularly beneficial. Such a washing appliance that also includes an agitator in support of such cleaning operations as may be preferred by certain users would also be beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides a washing appliance having a cabinet and a wash tub positioned in the cabinet and defining a wash chamber. A wash drum is rotatably mounted within the wash chamber and is configured for receiving articles for washing. An impeller is positioned in the wash drum, the impeller being rotational about a vertical axis and configured for imparting motion to the articles during washing. An agitator post is positioned adjacent to the impeller, the agitator post being rotational about the vertical axis. The agitator post includes a plurality of vane sets spaced apart along the vertical axis with each vane set including at least one helical vane.

In another exemplary embodiment, the present invention provides a washing appliance that includes a cabinet and a wash tub positioned in the cabinet and defining a wash chamber. A wash drum is rotatably mounted within the wash chamber and is configured for receiving articles for washing. An impeller is positioned in the wash drum, the impeller being rotational about a vertical axis and configured for imparting motion to the articles during washing. An agitator post is removably positioned adjacent to the impeller with the agitator post being rotational about the vertical axis. The agitator post includes a plurality of vane sets spaced apart along the vertical axis with each vane set including at least one helical vane. Each helical vane has a vane height and a vane length, wherein the vane height varies along the vane length.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numbers in the figures denotes same or similar features unless the context indicates otherwise.

DETAILED DESCRIPTION OF THE INVENTION

Figure 1:
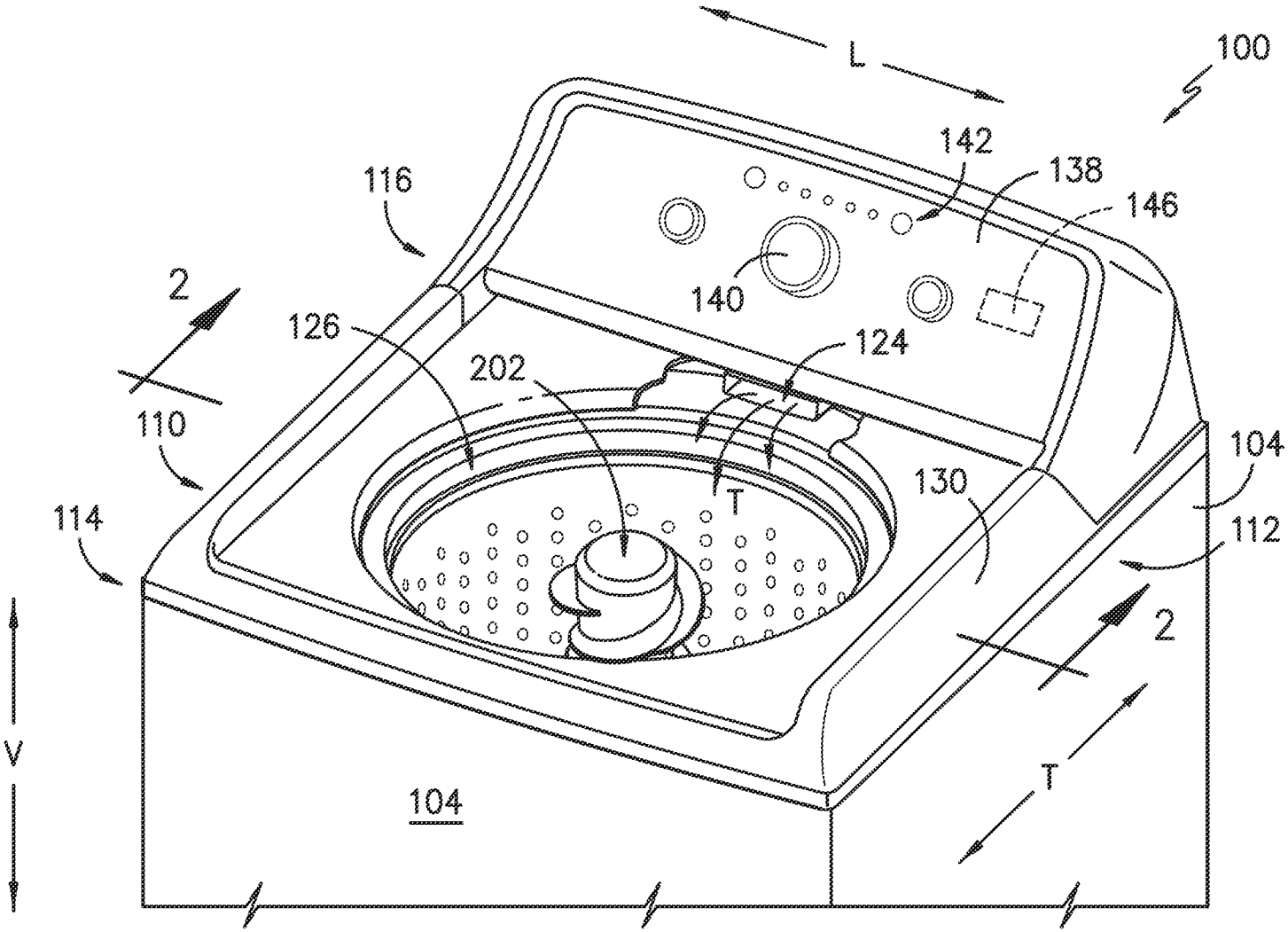
FIG. 1 provides a partial perspective view of an exemplary embodiment of a washing machine of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
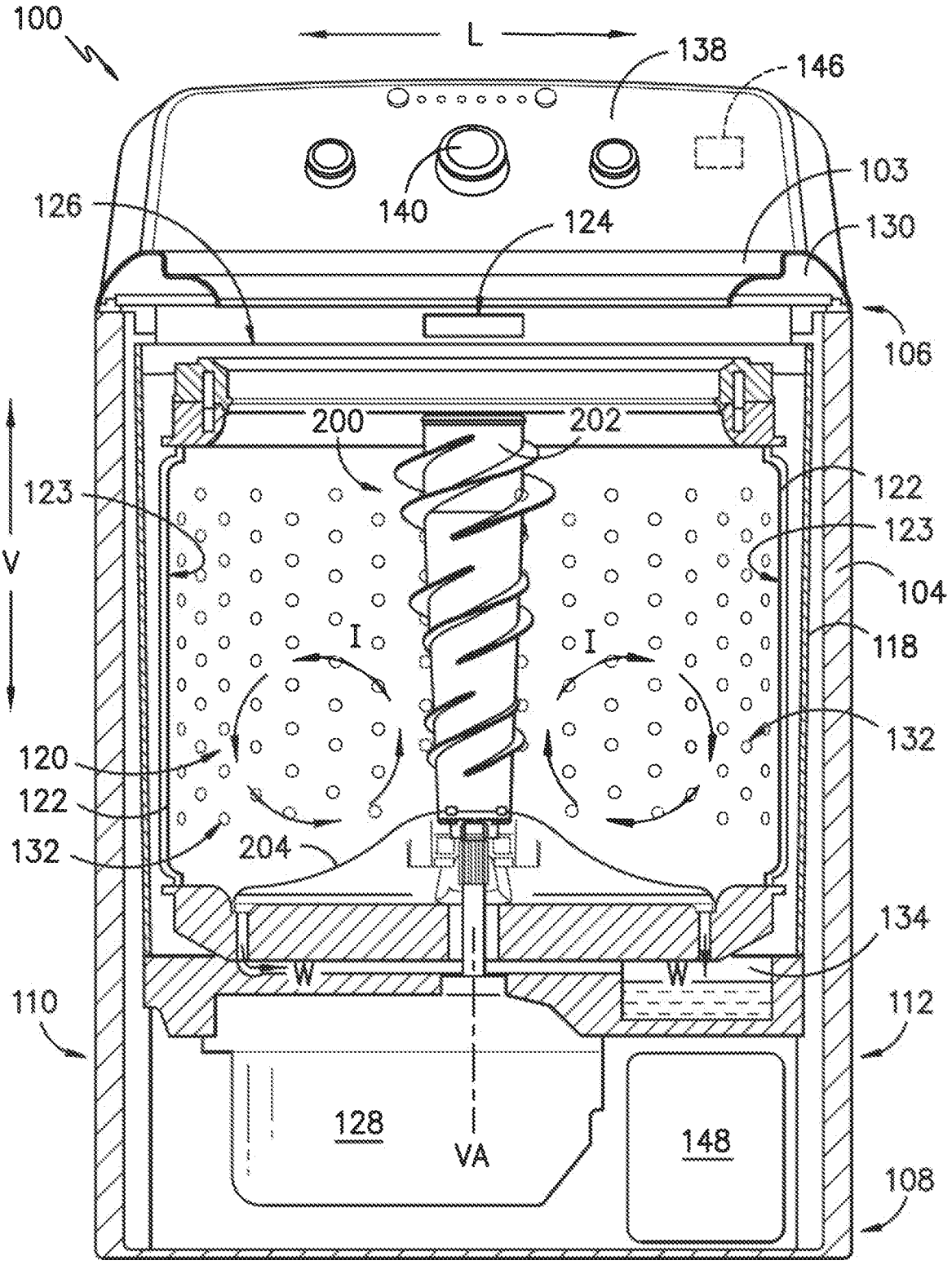
FIG. 2 provides a front cross-sectional view of the exemplary washing machine of FIG. 1.

FIGS. 1 and 2 illustrate an exemplary embodiment of a vertical axis washing appliance 100 of the present invention, which is also sometimes referred to as a top loading or vertical axis washing machine. In FIG. 1, a door 103 (shown in FIG. 2) has been removed for purposes of illustrating other features of the invention. Washing machine appliance 100 has a cabinet 104 that extends between a top portion 106 and a bottom portion 108 along the vertical direction V, between a first side (left) 110 and a second side (right) 112 along the lateral direction L, and between a front 114 and a rear 116 along the transverse direction T. The present invention is not limited to the particular vertical axis washing appliance 100 shown in the figures. Using the teachings disclosed herein, one or skill in the art will understand the other embodiments of a washing machine are also in the scope of the present invention.

As best shown in FIG. 2, a wash tub 118 is positioned within cabinet 102, defines a wash chamber 120, and is generally configured for retaining wash fluids during an operating cycle. A wash drum 122 is rotatably mounted within wash chamber 120 of wash tub 118. Washing machine appliance 100 further includes a dispenser 124 for dispensing wash fluid into wash tub 118. In addition, appliance 100 may include one or more additional dispensers for directing fluid into wash tub 118 and each dispenser may be separately controlled by one or more valves controlling flow to each dispenser independently of the others. The term "wash fluid" refers to a liquid used for washing and/or rinsing articles during an operating cycle and may include any combination of water, detergent, fabric softener, bleach, and other wash additives or treatments. As used herein, the term "cleaning cycle" includes a wash cycle, rinse cycle, spin cycle, or combinations thereof.

Wash drum 122 and cabinet 104 generally define an opening 126 (accessible through door 103) for receipt of articles for washing. Wash drum 122 rotates about a vertical axis of rotation VA (FIGS. 2 and 3) powered by motor assembly 128. According to the illustrated embodiment, the axis of rotation VA is substantially parallel to the vertical direction V. As used herein, terms of approximation, such as "approximately," "substantially," or "about," refer to being within a ten percent margin of error.

As illustrated, cabinet 104 of washing machine appliance 100 has a top panel 130. Top panel 130 defines an opening (FIG. 1) that coincides with opening 126 of wash drum 122 to permit a user access to wash drum 122. Door 103 is rotatably mounted to top panel 130 to permit selective access to opening 126. In particular, door 103 selectively rotates between a closed position and an open position. In the closed position, door 103 inhibits access to wash drum 122. Conversely, in the open position, a user can access wash drum 122. Although door 103 is illustrated as mounted to top panel 130, door 103 may alternatively be mounted to cabinet 104 or any other suitable support.

As best shown in FIG. 2, wash drum 122 further defines a plurality of perforations 132 to facilitate fluid communication between an interior of wash drum 122 and wash tub 118. In this regard, wash drum 122 is spaced apart from wash tub 118 to define a space for wash fluid to escape wash chamber 120. During a spin cycle, wash fluid within articles being washed (e.g., clothing) and within wash chamber 120 is urged through perforations 132 wherein it may collect in a sump 134 defined by wash tub 118. Washing machine appliance 100 further includes a pump assembly 148 (FIG. 2) that is located beneath wash tub 118 and wash drum 122 for gravity assisted flow when draining wash tub 118.

An exemplary article movement mechanism 200, including impeller 204 (FIGS. 2 and 3) and agitator post 202, is rotatably mounted within wash drum 122 to impart motion to articles and liquid in wash drum 122. More specifically, impeller 204 and agitator post 202 extend into wash drum 122 and assist agitation of articles disposed within wash drum 122 (as will be later described) during operation of washing appliance 100, e.g., to facilitate improved cleaning. In different embodiments, impeller 204 and agitator post 202 may rotate separately or together. Such rotations include a single action element (i.e., oscillatory only), a double action element (oscillatory movement at one end, single direction rotation at the other end) or a triple action element (oscillatory movement plus single direction rotation at one end, single direction rotation at the other end). Impeller 204, agitator post 202, and wash drum 122 are oriented to rotate about a vertical axis of rotation VA (which is substantially parallel to vertical direction V). For example, impeller 204 and/or agitator post 202 may rotate back and forth in alternate directions about vertical axis VA during a cleaning cycle. Additional description of the actions of impeller 204 and agitator post 202 are set forth below.

As stated, washing machine appliance 100 includes a motor assembly 128 in mechanical communication with wash drum 122 to selectively rotate wash drum 122 (e.g., during a wash cycle or a rinse cycle of washing machine appliance 100). In addition, motor assembly 128 may also be in mechanical communication with impeller 204 and agitator post 202. In this manner, motor assembly 128 may be configured for selectively and independently rotating or oscillating wash drum 122, impeller 204, and/or agitator post 202 during various operating cycles of washing machine appliance 100.

Figure 3:
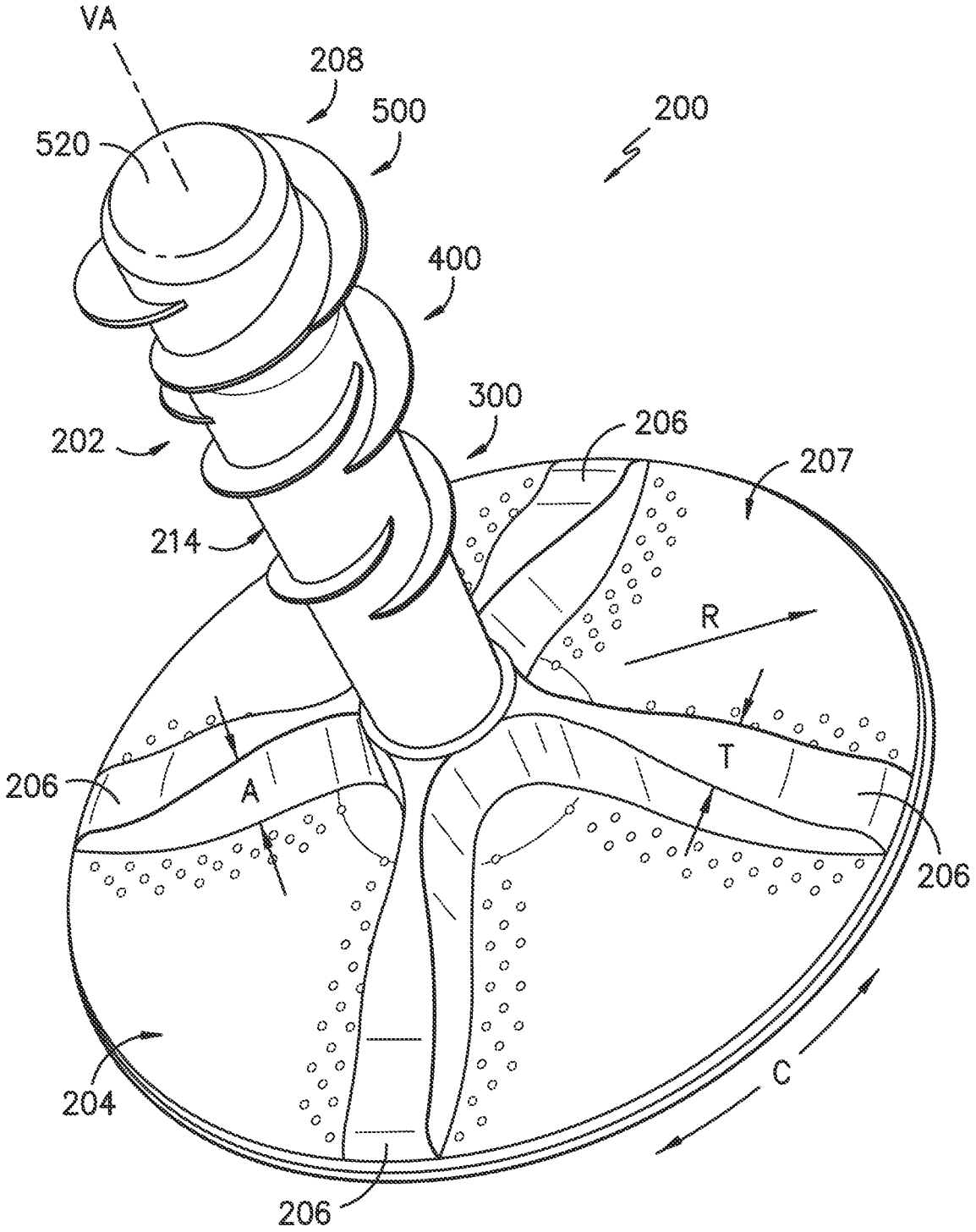
FIG. 3 provides a perspective view of an exemplary article movement mechanism of the present invention.

Referring still to FIGS. 1 through 3, a control panel 138 with at least one input selector 140 (FIGS. 1 and 2) extends from top panel 130. Control panel 138 and input selector 140 collectively form a user interface input for operator selection of machine cycles and features of washing appliance 100. A display 142 of control panel 138 indicates selected features, operation mode, a countdown timer, and/or other items of interest to appliance users regarding operation.

Operation of washing machine appliance 100 is controlled by at least one controller or processing device 146 that is operatively coupled to control panel 138 for user manipulation to select washing machine cycles and features. In response to user manipulation of control panel 138, controller 146 operates the various components of washing machine appliance 100 to execute selected machine cycles and features. According to an exemplary embodiment, controller 146 may include a memory and microprocessor, such as a general or special purpose microprocessor operable to execute programming instructions or micro-control code associated with methods described herein. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 138 and other components of washing machine appliance 100 may be in communication with controller 146 via one or more signal lines or shared communication busses.

During operation of washing machine appliance 100, laundry items are loaded into wash drum 122 through opening 126, and washing operation is initiated through operator manipulation of input selector 140. Water, detergent and/or other fluid additives can be added to wash tub 118 and wash drum 122 through dispenser 124 and/or other dispensers as well. Controller 146 can operate one or more valves of washing appliance 100 to provide for filling wash tub 118 and wash drum 122 to the appropriate level for the amount of articles being washed and/or rinsed. By way of example for a wash mode, once wash drum 122 is properly filled with fluid, the contents of wash drum 122 can be agitated (e.g., with agitator 136 as discussed previously) for washing of laundry items in wash drum 122. The specific operation of wash appliance 100 by controller 146 will depend on various inputs including the cycle and other settings that may be selected by the user, the amount of article placed in wash chamber 120, and other variables as will be understood by one of skill in the art using the teachings disclosed herein.

By way of continuing example, after wash tub 118 is filled and the agitation phase of the wash cycle is completed, wash tub 118 and drum 122 can be drained, e.g., by drain pump assembly 148. Laundry articles can then be rinsed by again adding fluid to wash drum 122 and wash tub 118 again depending on the specifics of the cleaning cycle selected by a user. The impeller 204 and/or agitator post 202 may also provide agitation within wash drum 122. One or more spin cycles may also be used as part of the cleaning process. In particular, a spin cycle may be applied after the wash cycle and/or after the rinse cycle in order to wring wash fluid from the articles being washed. During a spin cycle, wash drum 122 is rotated at relatively high speeds to help wring fluid from the laundry articles through perforations 132. After articles disposed in wash drum 122 are cleaned and/or washed, the user can remove the articles from wash drum 122, e.g., by reaching into wash drum 122 through opening 126.

As will now be further described, the exemplary article movement mechanism 200 allows desired movements to be imparted to articles in wash drum 122 during a cleaning cycle. These movements, which can include combinations of movement along vertical direction V and radial direction R, assist in cleaning articles while in the wash fluid. For example, after articles to be cleaned and fluid are loaded into cylindrical wash drum 122, rotations of impeller 204 may impart an inverse toroidal motion to articles in wash drum 122 during a cleaning cycle. The general path of this overall inverse toroidal movement is depicted by arrows I in FIG. 2. As shown, articles move vertically upward from impeller 204 along agitator post 202 and then radially outward (the radial direction is indicated by arrow R in FIG. 3, a direction perpendicular to vertical axis VA) at the top of an article load towards the cylindrical portion 123 of wash drum 122.

The articles then move vertically downward towards impeller 204 and radially inward along the bottom of an article load towards agitator post 202 where the cycle repeats under the influence of components such as impeller 204. Accordingly, during a cleaning cycle, this inverse toroidal motion can result generally in a turnover of articles in wash drum 122. As used herein, "inverse toroidal motion" or "inverse toroidal movement" does not refer to the specific movement necessarily of any individual article but to the overall movement of articles in wash drum 122 instead. A variety of factors create the inverse toroidal motion the occurs in wash drum 122 including, for example, the relative amounts of fluid and articles present in drum 122, the shape of wash drum 122, the configuration and movements of impeller 204 and other factors as well.

With reference to FIG. 3, for this exemplary embodiment, impeller 204 includes a plurality of radial lobes 206 spaced apart along circumferential direction C. Each lobe 206 has thickness T as measured along the circumferential direction C that varies moving along radial direction R. For the exemplary embodiment shown, thickness T narrows and then widens moving along radial direction R and away from agitator post 202. Each lobe 206 also has a height A about base 207 along axial direction A that also varies along radial direction R. For the exemplary embodiment shown, height A gradually decreases moving along radial direction R and away from agitator post 202. Impeller 204 as depicted in FIGS. 2 and 3 is provided by way of example only. Other shapes and configurations may be used as well.

As noted, the configuration of impeller 204 assists in creating the desired inverse toroidal motion depicted by arrows I in FIG. 2, which includes articles moving vertically upward from impeller 204 along agitator post 202. Agitator post 202 is configured to simultaneously to support this inverse toroidal movement and also provide one or more components in appliance 100 that certain consumers may significantly associate with cleaning effectiveness. An exemplary embodiment of agitator post 202 is set forth in the figures and will now be further described.

Referring to FIGS. 2 and 3, agitator post 202 is positioned adjacent to impeller 204 and connects into a recess provided by impeller 204 for this exemplary embodiment. Agitator post 202 extends along vertical axis VA between a top end 208 and a bottom end 210. At top end 208, agitator post 202 may be equipped with a removable cap 520 and/or other components may be also be incorporated therein. One or more drain holes may be included in agitator post 202 at e.g., bottom end 210 or other locations. At bottom end 210, a plurality of teeth or tabs 212 protrude vertically and are detachably connected in a complementary manner into slots (not shown) of impeller 204. As such, for this embodiment, impeller 204 and agitator post 202 move together and agitator post 202 may be removable. However, in other embodiments of the invention, the movements of impeller 204 and agitator post 202 can be separated. Additionally, different mechanisms for attachment of agitator post 202 to impeller 204 may be used.

Figure 4:
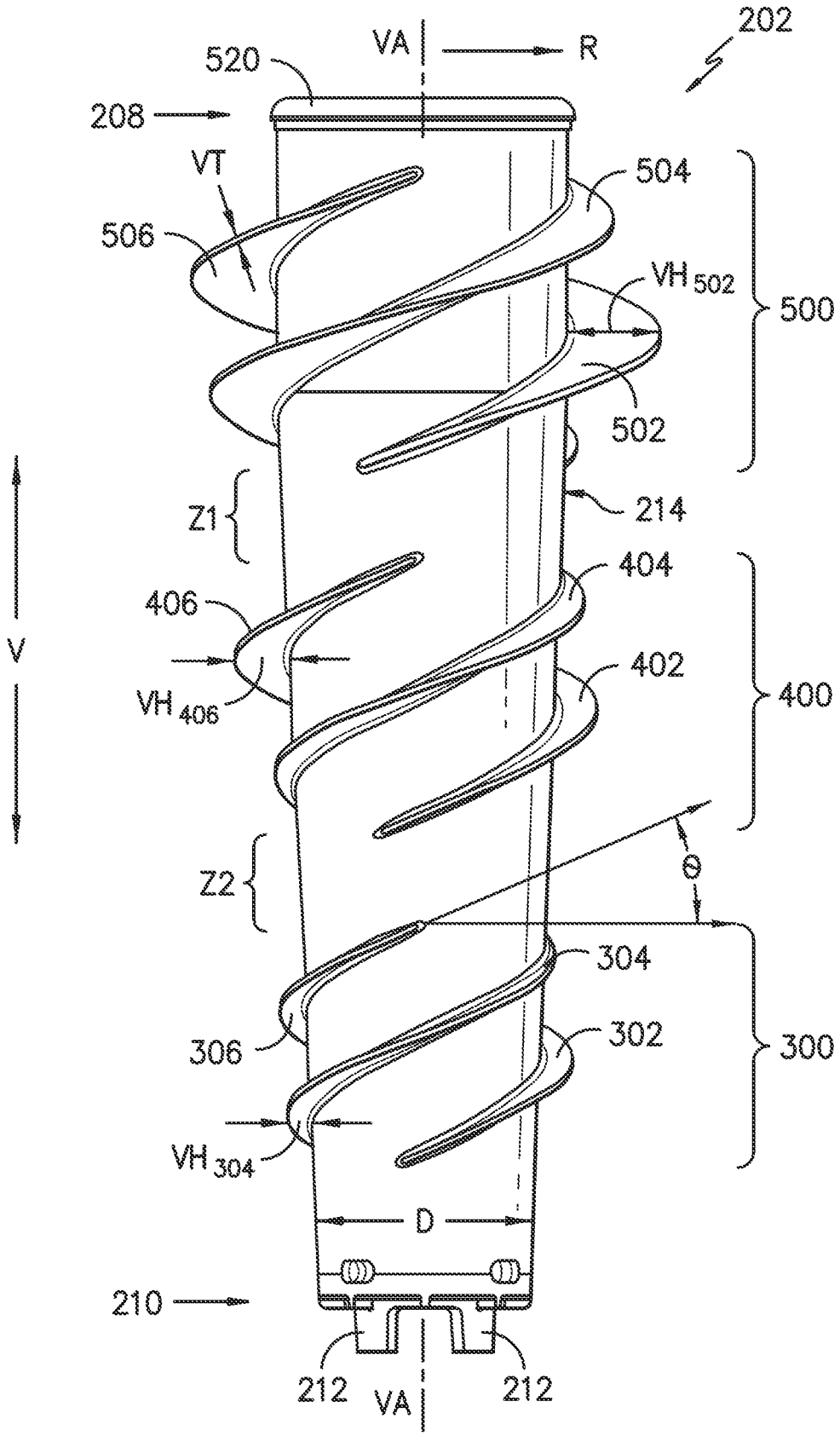
FIG. 4 is a side view of the exemplary agitator post that is also shown in FIG. 3.

As best shown in FIG. 4, along vertical axis VA, agitator post 202 includes a plurality of vane sets 300, 400, and 500. Each vane set includes at least one helical vane as will be further described. For this embodiment, three vane sets 300, 400, and 500 are illustrated. However, in other embodiments, agitator post 202 may have e.g., two vane sets or four vane sets along vertical axis VA.

With reference now to FIGS. 4 through 7, for this embodiment each vane set includes three distinct helical vanes extending radially from an outer surface 214 of agitator post 202. Outer surface 214 extends around agitator post 202 along circumferential direction C. For example, vane set 300 includes helical vanes 302, 304, and 306; vane set 400 includes helical vanes 402, 404, and 406; and vane set 500 includes helical vanes 502, 504, and 506. The number of helical vanes in each vane set 300, 400, and 500 may vary. For the embodiment shown in the figures, each vane set includes three respective helical vanes as just described. In other embodiments of the invention, each vane set can include e.g., 1, 2, or 4 helical vanes.

Figure 5:
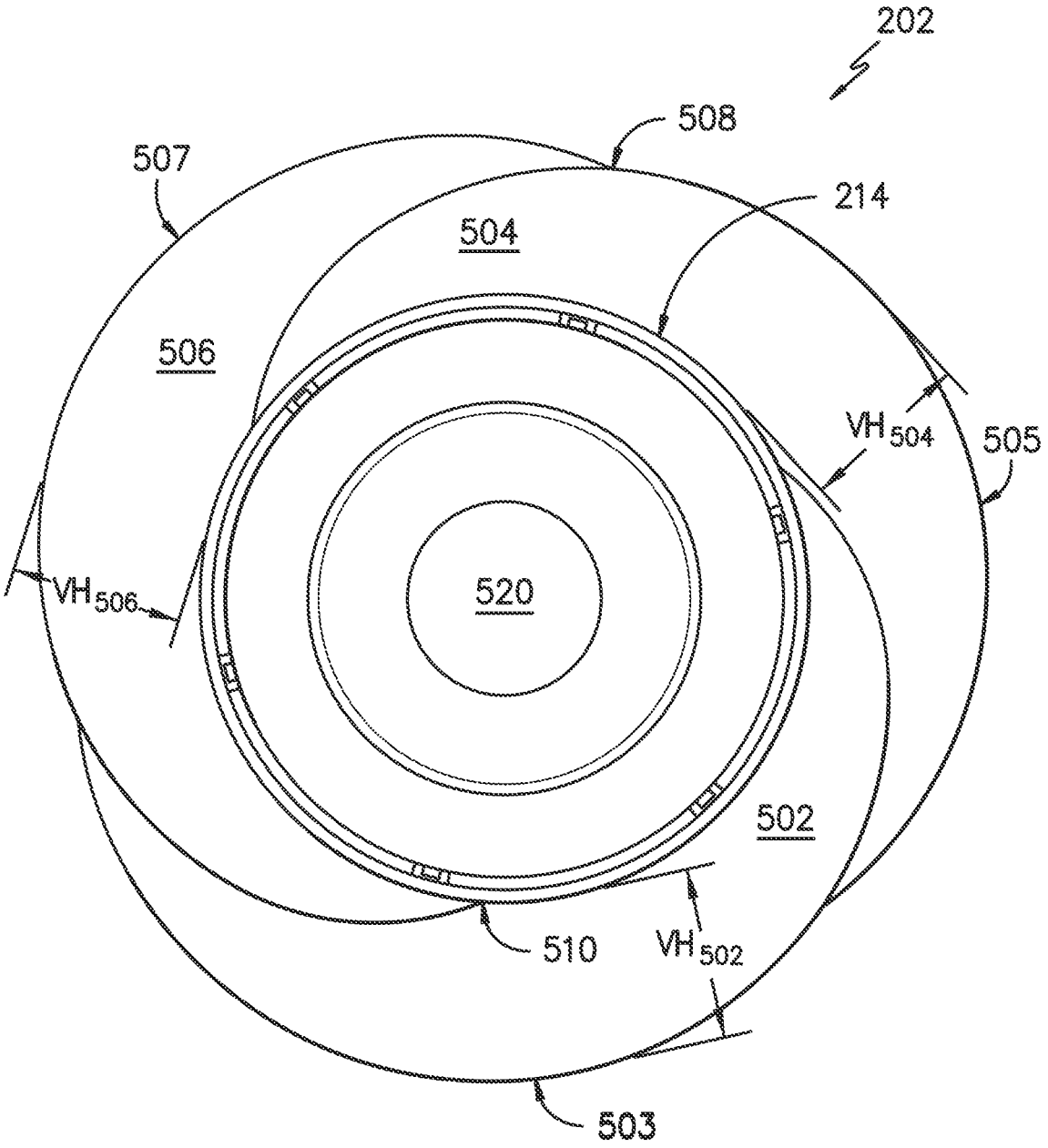
FIG. 5 is a top view and FIG. 6 is a bottom view of the exemplary agitator post of FIGS. 3 and 4.

Each helical vane creates a helix around vertical axis VA of agitator post 202. As shown in FIG. 5, each helical vane forms a helix angle θ to radial direction R. In one exemplary embodiment of the invention, helix angle θ has a value in the range of 10 degrees≤helix angle θ≤20 degrees.

Figure 6:
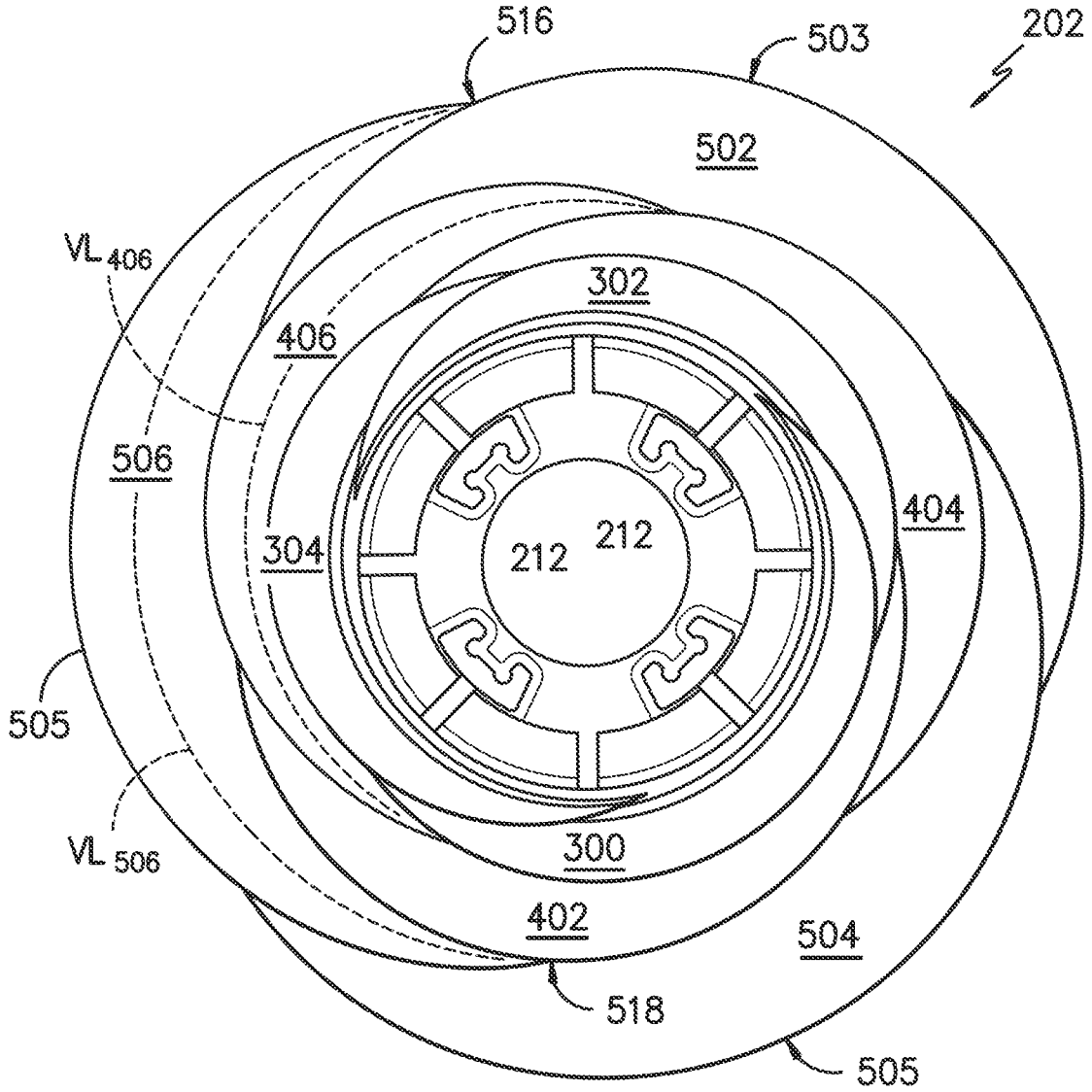
Figure 7:
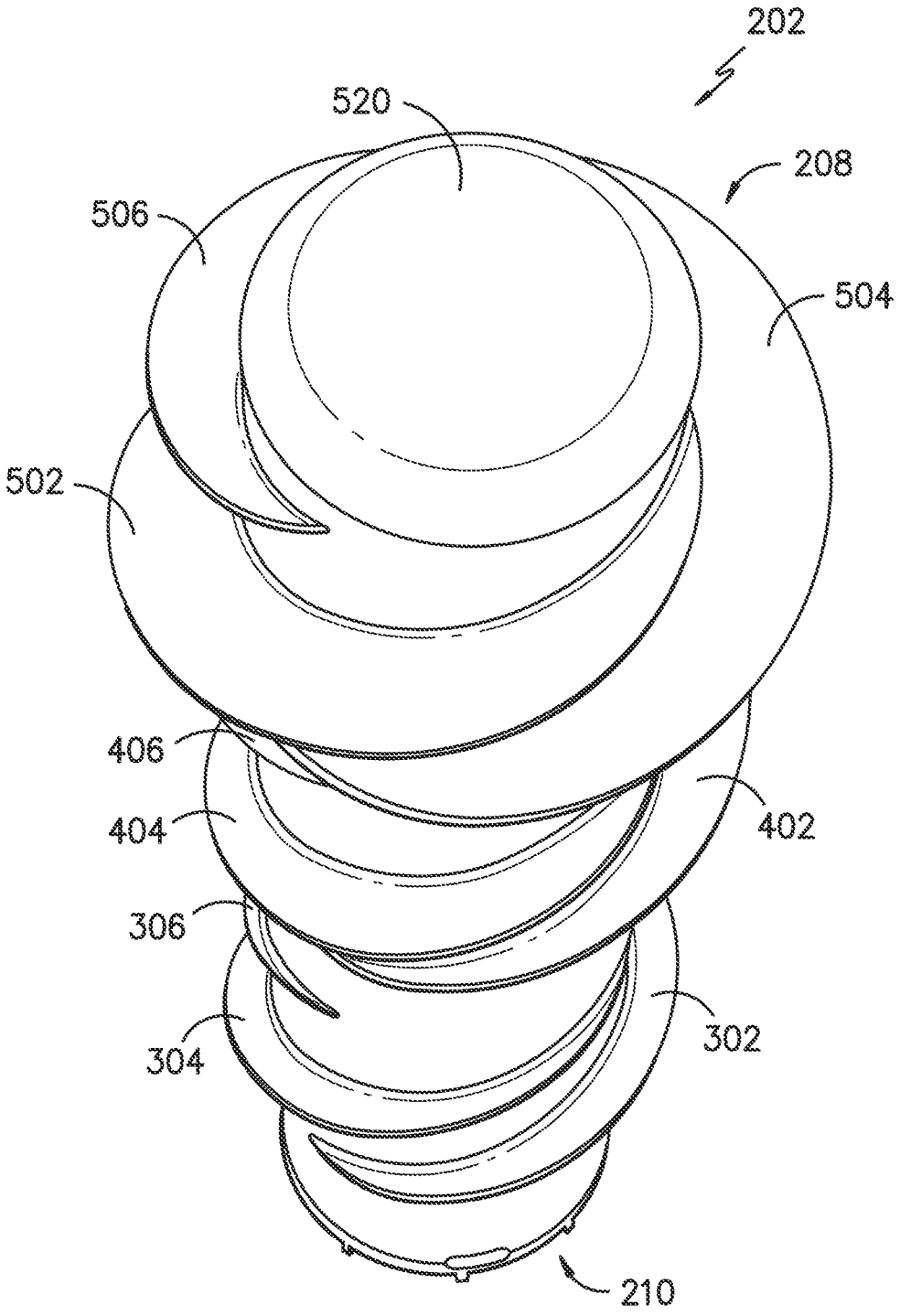
FIG. 7 is top perspective view of the exemplary agitator post of FIGS. 3, 4, 5, and 6.

Each helical vane has a radially-outer edge and extends along a vane length VL. For example, as shown in FIG. 6, helical vane 506 has a vane length $VL_{506}$ that is measured between termination points 516 and 518 along a line that is equidistant between radially-outer edge 505 and outer surface 214 of agitator post 202. As also shown in FIG. 6, for this exemplary embodiment, each helical vane extends at least 180 degrees in circumferential direction C around agitator post 202. Other configurations having different vane lengths VL may also be used.

Each helical vane has a vane thickness VT (FIG. 4) measured normal to its surface. For this exemplary embodiment, vane thickness VT is tapered along radial direction R and is constant along the direction of vane length VL (FIG. 6). For example, vane thickness VT may taper or decrease moving along radial direction R away from vertical axis VA. The contour of each helical vane along vane length VL may be smooth as illustrated or may include wavy configurations. Other configurations for thickness may be employed in alternative embodiments.

Each helical vane in vane sets 300, 400 and 500 has a vane height VH as measured along radial direction R, which is a direction orthogonal to vertical axis VA. More particularly, as used herein, vane height VH is measured from the outer surface 214 of agitator post 202 to the radially-outer edge of a helical vane. For example, as shown in FIG. 5, vane height $VH_{502}$ is the height of helical vane 502 at a given location along the length of the helix defined by vane 502 as it extends around agitator post 202 and is measured from outer surface 214 to radially-outer edge 503. As shown in FIGS. 3 through 5, vane height VH of each helical vane increases and decreases gradually along its respective vane length VL. For example, returning to FIG. 6, vane height $VH_{506}$ increases and then decreases move along vane length $VL_{506}$ from one termination point (516 or 518) to the other.

As shown in FIGS. 3 and 4, the vane height VH of the helical vanes also increases and decreases between vane sets 300, 400, and 500, respectively, so as to define groups of vanes—i.e. vane sets—that are vertically distinguishable from each other. As used herein, "vertically distinguishable" means that, due to changes in vane height VH along vertical direction V, vane sets can be identified that are distinct from each other. Overlapping and non-overlapping vane sets may be used in various embodiments of the invention.

For example, in the embodiment shown in the figures, vane sets 300, 400, and 400 are vertically distinguishable as such do not overlap along vertical axis VA—i.e. none of the individual helical vanes extend or continue between any of the vane sets along vertical direction V. The vane height VH of each helical vane in vanes sets 300, 400, and 500 rises to a maximum value within its respective vane set and diminishes to a zero value between vane sets so that no overlap between vane sets along vertical direction V occurs. This creates zones (Z1 and Z2) between vane sets where no helical vane is present.

In an alternative embodiment of the invention, helical vanes may extend between vane sets 300, 400, and 500. However, for such an embodiment, the vane sets are still vertically distinguishable from each other because the vane heights would rise to a maximum value within the vane sets and diminish to a minimum (but non-zero) value between vane sets. Zones Z1 and Z2 would still exist but with a helical vanes having minimum values for vane height VH.

Referring again to FIG. 4, agitator post 202 can have various profiles along the vertical direction as created by outer surface 214. For this exemplary embodiment, agitator post 202 has a frustoconical shape in that agitator post diameter D increases in a linear manner along vertical direction D moving away from impeller 204. In other embodiments of the invention, post diameter D may be uniform or curved along vertical direction D.

As previously described, article movement mechanism 200 with agitator post 202 provides for inverse toroidal movement of articles in wash tub 118. Agitator post 202 supports such movement. For example, the helical vanes of agitator post 202 can impart radial and axial motion to articles during a cleaning cycle to assist in the cleaning process and do so without causing significant interference in the inverse toroidal motion of the articles that is created by a variety of factors as previously described. At the same time, agitator post 202 may be appealing to certain users who conventionally associate having a vertical agitator post with the cleaning ability of a washing appliance.

The effectiveness of article movement mechanism 200 desirably can allow for the use of smaller amounts of water, higher detergent concentrations, or both, during cleaning cycles. For example, for clothes or other textile garments, a load ratio in the range of 0.9 to 1.5 gallons of water per pound of garments may be used.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing; and an agitator post positioned adjacent to the impeller, the agitator post being rotational about the vertical axis, the agitator post comprising at least three vane sets spaced apart along the vertical axis, each vane set including at least one helical vane;

wherein the vane sets are vertically distinguishable from each other and do not overlap along the vertical direction.

2. The washing appliance of claim 1, wherein each helical vane has a vane thickness that is tapered along a radial direction that is orthogonal to the vertical axis.

3. The washing appliance of claim 2, wherein each helical vane has a vane length, and wherein the vane thickness of each helical vane is constant along its vane length.

4. The washing appliance of claim 1, wherein the agitator post comprises four vane sets.

5. The washing appliance of claim 1, wherein each helical vane forms a helix angle in a range of 10 to 20 degrees from a radial direction.

6. The washing appliance of claim 1, wherein each vane set includes one to four vanes.

7. The washing appliance of claim 1, wherein each vane set includes three vanes.

8. The washing appliance of claim 1, wherein each helical vane has a vane height extending along a radial direction from an outer surface extending around the agitator post, and wherein vane heights of the vane sets decrease between vane sets in a direction moving along the vertical axis towards the impeller.

9. The washing appliance of claim 1, wherein the agitator post has a frustoconical shape and defines an agitator post diameter that increases in a direction moving along the vertical axis moving away from the impeller.

10. The washing appliance of claim 1, wherein each vane extends at least 180 degrees around the agitator post.

11. The washing appliance of claim 1, wherein the impeller is configured for imparting an inverse toroidal motion to the articles during a cleaning cycle.

12. The washing appliance of claim 1, wherein the agitator post is detachably connected to the impeller.

13. The washing appliance of claim 1, further comprising a removable cap connected to the agitator post.

14. The washing appliance of claim 1, wherein the vane sets do not overlap along the vertical axis.

15. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing; and an agitator post removably positioned adjacent to the impeller, the agitator post being rotational about the vertical axis, the agitator post comprising at least three vane sets spaced apart along the vertical axis, each vane set including at least one helical vane, each helical vane have a vane height and a vane length, wherein the vane height varies along the vane length, and wherein the vane sets are vertically distinguishable from each other.

16. The washing appliance of claim 15, wherein the agitator post comprises four vane sets.

17. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing; and an agitator post positioned adjacent to the impeller, the agitator post being rotational about the vertical axis, the agitator post comprising a plurality of vane sets spaced apart along the vertical axis, each vane set including at least one helical vane; wherein each vane set includes at least three vanes; wherein the vane sets are vertically distinguishable from each other and do not overlap along the vertical direction.

* * * * *